US012565749B2

(12) United States Patent
Reinke et al.

(10) Patent No.: US 12,565,749 B2
(45) Date of Patent: Mar. 3, 2026

(54) PATH OR ROAD BARRIER FOR VEHICLES

(71) Applicant: Perimeter Protection Germany GmbH, Salzkotten (DE)

(72) Inventors: Thomas Reinke, Wernigerode (DE); Paul Eichwald, Paderborn (DE)

(73) Assignee: PeriGuard GmbH, Salzkotten (DE)

( * ) Notice: Subject to any disclaimer, the term of this patent is extended or adjusted under 35 U.S.C. 154(b) by 628 days.

(21) Appl. No.: 18/011,897

(22) PCT Filed: Jun. 17, 2021

(86) PCT No.: PCT/EP2021/066484
§ 371 (c)(1),
(2) Date: Dec. 21, 2022

(87) PCT Pub. No.: WO2022/002621
PCT Pub. Date: Jan. 6, 2022

(65) Prior Publication Data

US 2023/0243116 A1 Aug. 3, 2023

(30) Foreign Application Priority Data

Jul. 2, 2020 (DE) ..... 10 2020 117 461.6

(51) Int. Cl.
*E01F 13/12* (2006.01)

(52) U.S. Cl.
CPC ..... *E01F 13/123* (2013.01)

(58) Field of Classification Search
CPC ..... E01F 13/123
USPC ..... 404/6, 9–11
See application file for complete search history.

(56) References Cited

U.S. PATENT DOCUMENTS 1,766,073 A * 6/1930 Hartzler ..... E01F 9/602 404/10
1,931,174 A * 10/1933 Withers ..... E01F 9/602 404/10
2,774,323 A * 12/1956 Kirk ..... E01F 9/602 116/63 P
3,875,720 A * 4/1975 Russell ..... E01F 9/627 403/291

(Continued)

FOREIGN PATENT DOCUMENTS

DE 199 28 036 A1 12/2000
EP 1 900 878 A1 3/2008

(Continued)

*Primary Examiner* — Raymond W Addie
(74) *Attorney, Agent, or Firm* — Salter & Michaelson

(57) ABSTRACT

The invention relates to a path or road barrier for vehicles, having a foundation which can be inserted into a depression of the driving surface and in which a recess is located. A bollard barrier part (30) is arranged in the recess of the foundation (10), and the path or road barrier is to prevent vehicles with a preferred travel direction in particular from passing through, said travel direction being oriented against the bollard barrier part (30) as the impact direction (15). The bollard barrier part (30) is made of two or more panels (31, 32, 33, 34) which can be handled separately from one another, said panels (31, 32, 33, 34) being arranged parallel to one another. The impact direction (15) is oriented against an impact face (35) of the bollard barrier part (30), said impact face being arranged perpendicularly to the panels (31, 32, 33, 34).

20 Claims, 1 Drawing Sheet

(56) References Cited

U.S. PATENT DOCUMENTS

| | | | | |
|---|---|---|---|---|
| 4,542,709 | A * | 9/1985 | Spaugh | B60Q 7/00 116/63 P |
| 4,762,439 | A * | 8/1988 | Carlyle | E01F 13/085 404/11 |
| 5,775,832 | A * | 7/1998 | Kilgrow | E01F 13/12 404/6 |
| 6,454,488 | B1 * | 9/2002 | Lewis, Sr. | E01F 15/146 404/6 |
| 6,702,512 | B1 * | 3/2004 | Reale | E01F 13/123 404/6 |
| 7,198,426 | B2 * | 4/2007 | Kang | E01F 15/088 404/9 |
| 7,258,505 | B2 * | 8/2007 | Dehart | E01F 15/085 404/9 |
| 7,494,112 | B2 * | 2/2009 | Fromm | E01F 13/12 256/64 |
| 12,173,460 | B2 * | 12/2024 | Neusch | E01F 15/003 |
| 2011/0033232 | A1 * | 2/2011 | Adler | E01F 13/12 404/6 |
| 2014/0010591 | A1 * | 1/2014 | Ball | E01F 13/12 404/6 |
| 2015/0016883 | A1 | 1/2015 | Gerrard et al. | |
| 2019/0323187 | A1 * | 10/2019 | Klein | E01F 13/123 |

FOREIGN PATENT DOCUMENTS

| | | |
|---|---|---|
| EP | 2836644 | 10/2016 |
| GB | 2282838 | 4/1995 |
| GB | 2503682 | 1/2014 |
| WO | 2007/105940 | 9/2007 |

* cited by examiner

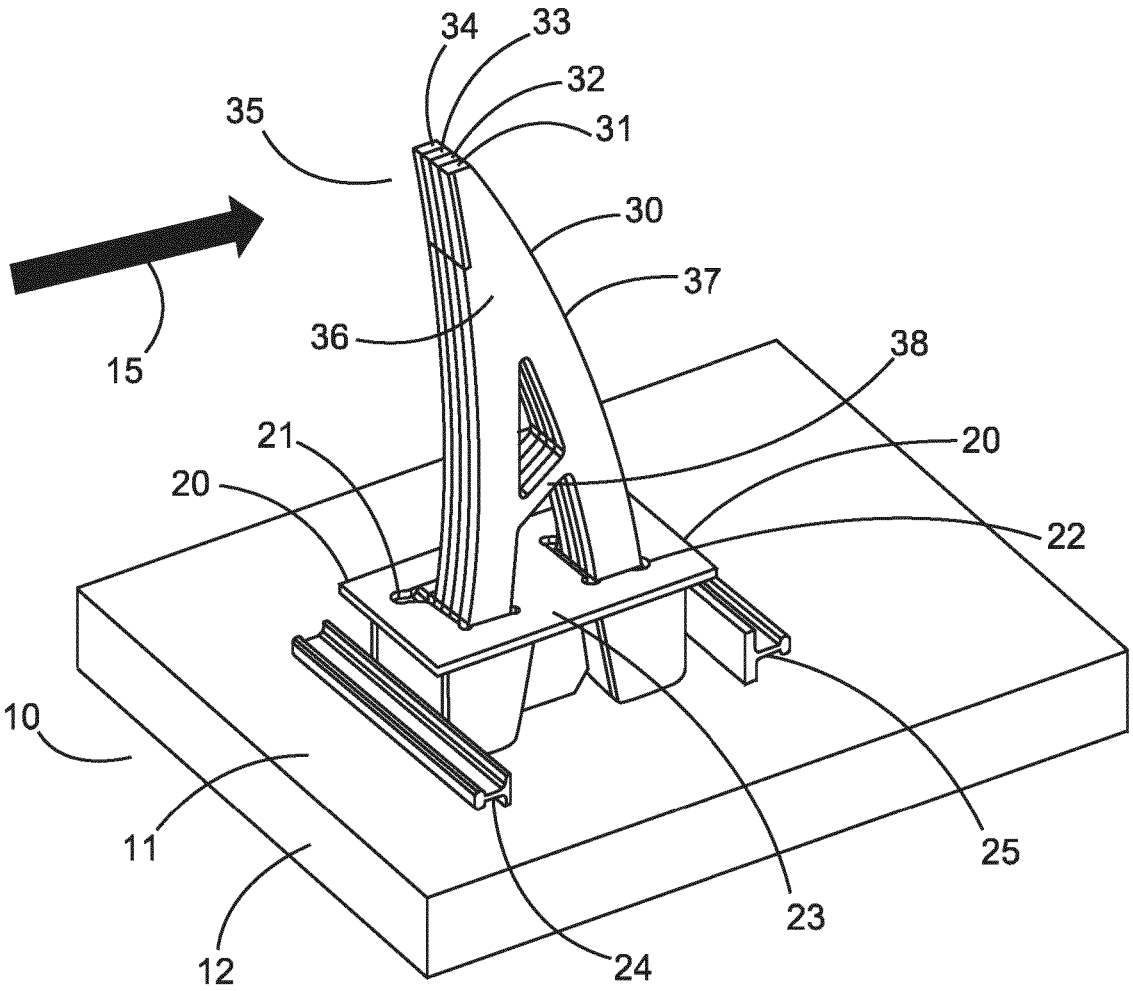
34
33
32
31
35
30
37
15
36
38
21
20
20
22
10
11
12
24
23
25

PATH OR ROAD BARRIER FOR VEHICLES

TECHNICAL FIELD

The invention relates to a path or road barrier for vehicles, having a foundation that can be inserted into a depression of the driving surface, in which foundation a recess is located, and having a bollard barrier part that is arranged in the recess of the foundation, for [blocking]* vehicles with a preferred travel direction, which is oriented as the impact direction against the bollard barrier part.

*Text in brackets is not given in the German document.—Translator's note

BACKGROUND OF THE INVENTION

Path or road barriers for vehicles serve, in particular, for blocking off regions that are intended to be inaccessible for vehicles, in particular motor vehicles. Such regions are, for example, pedestrian zones, but also regions that are relevant to safety and into which unauthorized vehicles are not permitted to drive from the outside.

Depending on the situation, different types of path or road barriers of this kind are desired. Thus, there exist path or road barriers that are intended to block the path or the road only temporarily and, during other periods of time, to permit the traffic to pass unhindered. However, there also exist path or road barriers that are intended to block the corresponding roadway permanently or as a general rule. This is the case, for example, when a path was initially provided for the construction of a safety-relevant installation and should allow the passage of construction vehicles, but, after the safety-relevant installation has been finished, a passage via the roadway is no longer desired.

Further cases are, for instance, pedestrian regions that are to be completely blocked off and are to be driven on only in exceptional cases by temporary disassembly of the path and road barriers.

Extendable bollards for temporary and reversible blocking of vehicles are known, for example, from DE 199 28 036 A1. In this case, a path or road barrier that has a positionally fixed, sleeve-like standing part, the interior of which forms a recess in the ground, and is equipped with a blocking part that can be extended upwards and retracted downwards relative to it, which, in the lowered state, is arranged in the recess. This blocking part is therefore arranged in the ground so as to be vertically extendable and can block the path or the road as desired.

Other constructions are known, for example, from EP 1 900 878 A1, in which a more complex element that can swing out around a horizontal axis and has side walls and access ramps is known. Here, too, a positionally fixed standing part in the form of a box or frame is, in turn, sunk into the ground and, in this case, a blocking part, which can move relative to it, can be moved relative to the standing part as a larger blocking portion.

Movable path or road barriers of this kind for vehicles require, of course, a drive for the movement and this, in turn, sets limits to the massiveness and the resistance that path or road barriers of this kind can oppose to impacting vehicles.

This constraint does not exist in the case of path and road barriers that are not extendable or retractable. Examples thereof are known, for instance, from EP 2 836 644 Bl. Here, there is no blocking part that can move relative to a standing part. Instead, after assembly, the individual elements cannot move relative to one another and a temporary passage of these path and road barriers under certain circumstances is not provided for. These safety barriers usually are made of steel and are embedded in concrete. Various metal rods are bolted together at an angle and are intended to form a complex structure that is as stable as possible for stopping impacting vehicles.

This is indeed accomplished, but embodiments of path or road barriers of this kind are very specifically defined. The model that is installed in the ground is practically unalterable and there exist no variants that can be altered without great effort.

Added to this is also the fact that path or road barriers of this kind are very heavy, thereby making their installation possible only with correspondingly even heavier tools and necessitating a very costly and time-consuming process to uninstall them during later removal.

It would be desirable to be able to employ a path or road barrier of the type that, although movable, still makes possible a more flexible utilization, that is, for example, allows various embodiments that are able to meet various requirements and nonetheless are produced and can be made available in essentially the same way, but can take into account the different external constraints of available space as well as a targeted resistance towards impacting vehicles.

It also needs to be considered here that the space is restricted owing to underground electrical cables or district heating or water lines extending in the area in question or only an asymmetrical space with unfavorable dimensions is available on account of adjacent buildings.

The problem is therefore to propose a path or road barrier for vehicles that offers more possibilities for a variable structure, but still can be produced and installed economically.

SUMMARY OF THE INVENTION

This problem is solved in accordance with the invention by a path or road barrier for vehicles, having a foundation that can be inserted into a depression of the driving surface, in which foundation a recess is located, and having a bollard barrier part that is arranged in the recess of the foundation for [blocking] vehicles with a preferred direction of travel, which is oriented as the impact direction against the bollard barrier part, wherein the bollard barrier part is made of two or more panels that can be handled separately from one another, wherein the panels are arranged parallel to one another, and wherein the impact direction is oriented against an impact face of the bollard barrier part, said impact face being arranged perpendicularly to the panels.

The problem can be surprisingly solved by way of such a construction.

It needs to be taken into consideration here that the vehicles in question, whose travel through the region to be blocked off is presumed, always have the same direction of travel or an essentially similar direction of travel. When what is involved is a former path or a former road that has been blocked off, the course of this road is followed by the vehicles, namely, from the region released for use into the region no longer available for use. However, if the direction of travel is always the same, then the presumed impact direction of the vehicle at the path or road barrier is always the same.

The construction design in accordance with the invention uses panels, which in the form of layers, form a bollard, and the arrangement of these panels or layers adjacent to one another in relation to the presumed impact direction makes it possible, by way of a quite simple change in the number and size of the panels or layers used, to adapt both the dimensions and the weight as well as the resistance force that is provided against impacting vehicles in an almost modular manner relating to the possibilities and desires that are presented.

This means that a modular expansion of the bollard makes it relatively simple to achieve so-called higher impact classes, without having to resort to completely different constructions, which would necessitate a completely new design. Instead, it is possible in a simple manner to include additional panels or layers and also to take them into account manually.

It is therefore of special advantage here that the individual panels or layers are substantially lighter, that is, weigh less than do the complex and voluminous steel constructions of the prior art, which have to be installed at angles. In accordance with the invention, it is sufficient simply to set the additional panels in place by hand.

Using panels with a weight of less than 55 kg, that is, panels that can be manipulated by hand, it is possible to construct very many different embodiments.

The structure of the bollard barrier part from a plurality of panels is not coincidental or arbitrary, but rather the individual panels are placed precisely in the direction of travel or the presumed impact direction of the vehicle. An impacting vehicle therefore causes an individual panel to shift in place within the plane of the panel. The result of this is that, during an impact, each of the panels has to shift in place parallel to another panel, whereby even small deviations of the angle that can be regarded as mostly existing during an impact lead to relative movements of the individual panels with respect to one another and, accordingly, to corresponding friction and even better energy absorption.

In another arrangement of the panels, the impacting vehicle would virtually directly hit one panel surface, namely, the surface of a single panel, with further panels only being situated behind it. Here, the absorption of energy during impact is substantially less.

Each individual panel or layer can exhibit structures having an optimized topology and, accordingly, can be adapted to different external requirements.

Owing to the high flexibility of the structure of the overall concept of the path or road barrier, it is also possible, in addition to the panels or layers, to fix in place or attach elements that are furnished with recesses or fastening elements.

These recesses or fastening elements can be provided in a neutral fiber and have bored holes. It is then additionally possible, for instance, to attach fastening elements for blocking off pedestrian traffic between two bollards, when this is desired. Of course, these fastening elements can also be dismantled once again when, for example, after a concert performance with restricted access, they are no longer required.

It is also possible to attach totally different elements, to which, for instance, dog leashes, bicycle locks, or other elements are fastened.

The path or road barriers, which are commonly also to be referred to as bollards, can also be coupled to one another by means of rigid pipes or rigid solid rods of diverse cross sections or else by means of flexible connectors, such as, for instance, chains or cords.

If the constraints make it seem reasonable, the individual panels or layers can also be arranged with a lateral spacing with respect to one another, but, of course, they can also be arranged without any spacing. This means that it is possible to create intervening spaces in the bollards, something not possible in prior art.

The panels or layers can optionally also be joined to one another in a fixed manner, although it is also possible to join to them to one another in a non-fixed manner in order to achieve certain effects resulting from the relative movement of the layers parallel with respect to one another, such as, for example, to use frictional effects to influence the preferred directions during the braking of impacting vehicles.

The friction between the panels and layers of the panel elements results in an increase in the dissipation of the kinetic energy of the impacting vehicle.

The panels or layers can also be bolted together or adhesively bonded to one another in order to join them.

The numerous possibilities for the external shape of the panels or layers make it possible already to furnish this resulting structure with an advantageous architectonic appearance, thereby making path or road barriers into attractive elements in the surroundings of the area to be demarcated. Especially in the technical sphere of fixtures of this kind, this is uncommon and also affords an advantageous access to the space behind the path and road barriers that is actually to be protected.

It is also possible to design the functional elements in such a way that, at the same time, they possess an attractive design and no more additional coverings are required in order to conceal unattractive machine elements from the eyes of the surroundings. It is also possible to construct the panels or layers from individual elements, which, although monochrome in each case, together exhibit a different combination of various colors. This is not possible using the hitherto complex path or road barriers. In accordance with the invention, it is now conceivable by way of a corresponding color mix of the corresponding panels or layers, for example, also to reproduce national colors or sport club colors in order to incorporate, on the one hand, a blocking off of embassy buildings and, on the other hand, a blocking off of soccer stadiums in accordance with the preferred colors of the operators of the areas to be protected.

The lateral surfaces of the outermost panels or layers are flat and can therefore be utilized for the attachment of posters, LED displays, emblems, or laser engravings.

The energy absorption occurs in a targeted manner during impact of the vehicle against the path or road barriers as a result of a plastic deformation of the bearing structure, that is, as a result of a crushing of the layers or panels.

It is possible to use, for example, laser-processed sheet metal.

Also used are crane structural steel, bainitic steel, steel made of or containing martensite phases, or other high-strength steels.

Suitable for certain areas of application are also fiber composite materials in order to form panels or layers.

Also possible or advantageous for certain areas of application is the use of resilient elements in combination with the high-strength steel.

Subportions of the panels or layers in the back region of the material are, in general, less relevant in terms of function. These regions can be exploited in order to arrange or utilize there also panels that incorporate a specific three-dimensional design in this layer, such as, for instance, a palm or a star in side section.

Another advantage lies in the fact that, through the use of a plurality of panels or layers, it is possible also to assign a different effect to them, such as, for example, to arrange smaller spikes or corrugations on the impact face of these functional elements in order to bring about a deliberate stopping or damaging of the impacting vehicle by the path or road barrier.

It is further possible to construct the individual layers out of different materials and, in this way, to exploit the advantages of hybrid materials, even though each individual panel or layer is made of one solid material.

Beyond this, it is possible to provide for a height gradation of the panels or layers. This permits a modular stiffness of the bearing structure in the height direction. The result thereof is that different structural components of the impacting vehicle are each affected detrimentally during the impact process.

Furthermore, it is possible to furnish some or all of the panels or layers with an additional curvature in the impact direction of the presumed impacting vehicle. For technical reasons, a negative curvature has been found to be advantageous in this case.

Embodiments of this kind exhibit advantageous modes of behavior when trucks impact these path and road barriers. The hitherto occasionally observed tendency of trucks, after impacting these path and road barriers, to surmount them is eliminated.

The bollard barrier part is preferably inserted into a quiver apparatus. This quiver apparatus is housed in the generally cast foundation or in a recess that is left free or simultaneously formed there. This has the advantage that the quiver apparatus is anchored firmly and especially stably in the ground.

The bollard barrier part can then be inserted from above into this quiver-like apparatus. The bollard barrier part consists of a plurality of panels. The normals to the faces of each of these panels are horizontal to the ground and perpendicular to the impact direction. For the observer, each panel thus stands virtually like a wall, against the narrow side of which the approaching vehicle impacts. All "walls" are hereby parallel with respect to one another and, accordingly, the vehicle drives more or less simultaneously against all narrow sides of all walls of the bollard barrier part.

Visually, the bollard barrier part consisting of the various panels creates the impression of being virtually inserted into the quiver and, owing to the ability to handle the individual panels manually, the "quiver" is also filled in succession.

In summary, the path or road barrier is characterized preferably in that a quiver apparatus is provided, which is arranged in the recess in the foundation and into which the bollard barrier part with its panels, which can be handled separately from one another, is inserted.

It is hereby especially preferred that the quiver apparatus has at least two recesses, which are arranged in the impact direction one behind the other. This concept has the advantage that the bollard barrier part can be inserted into two different recesses and each of these two recesses forms, together with the quiver-like sections of the panels inserted in it, a resistance against the impacting vehicle.

It is hereby especially advantageous when the impact face of the bollard barrier part is formed by the narrow sides of the panels of the bollard barrier part that are arranged adjacent to one another and parallel with respect to one another.

The cover of the so-called quiver provided in accordance with the invention can be furnished with load-optimized radii.

An obstacle in front of or behind the quiver can be employed to introduce the load into the foundation over a large area. This obstacle can be, for example, a bar, a pipe, rods with rectangular cross sections, or else a standard rail.

Crane structural steel can also be used for the cover of the quiver. Further conceivable for certain applied cases is bainitic steel, steel with martensite phases, and also fiber composite materials.

The concept in accordance with the invention makes it possible, without greater effort and, in particular, without any impairment of the load-dissipating structures, also to undertake an illumination by employing a covered cable feedthrough.

The quiver is, in particular, arranged horizontally.

The quiver can be secured by molded elements against the panel elements being pulled out both in and also opposite to the impact direction and/or orthogonal to the impact direction and/or by a combination of these variants.

DESCRIPTION OF THE DRAWINGS

Preferred features of the invention will be described in detail below on the basis of the drawing and the dependent claims.

An exemplary embodiment of the invention will be described below on the basis of the drawing. Shown is:

FIG. 1 a perspective, schematic illustration of an embodiment of the path and road barrier according to the invention.

FIG. 1 shows schematically a very simplified illustration of an exemplary embodiment of the present invention with the key elements. Alternative embodiments are conceivable in large number and can modify various ones of the fundamentally likewise present elements.

Seen is a path and road barrier. Not depicted is a ground surface that forms a driving surface for vehicles, which, in the absence of the path and road barrier, could pass the region of the ground surface on the driving surface of interest here.

In the illustrated embodiment, however, a situation is to be regarded in which, in particular, a truck arrives from the left at the situation depicted in FIG. 1 and, purely theoretically, desires to leave the FIGURE once again at the top right. Accordingly, it follows the direction indicated by an arrow 15.

DETAILED DESCRIPTION

In the ground or in the driving surface, a foundation 10 is set. In practice, a corresponding hole is dug in the driving surface or is utilized and a concrete foundation, which is explained in more detail below, is poured there.

It is seen in FIG. 1 that the foundation 10 rests against the top side 11, which is flush with the ground surface, which is not depicted. The ground adjoins the foundation 10 in the simplified illustration of FIG. 1 at a plurality of lateral surfaces 12.

Situated inside of the foundation 10 in the central region is a quiver apparatus 20. In many preferred embodiments, this quiver apparatus 20 is cast along with the casting of the foundation 10, so that it cannot be removed with substantial forces. In the illustrated embodiment, the quiver apparatus has two recesses 21 and 22 and a quiver cover 23.

The quiver cover 23 is flush with the top side 11 of the foundation 10 and thus also with the ground surface and the driving surface.

Moreover, the quiver apparatus 20 is supported by two reinforcing elements, which are co-cast in the foundation 10. In the illustrated embodiment, these reinforcing elements 24 and 25 take the form of rails in order to assist still further the anchoring of the entire quiver apparatus 20 inside of the foundation 10. Instead of rails, it is also possible to use bars, pipes, panels, or rods with rectangular cross sections.

Accordingly, all of the above-described elements lie below the ground surface or reach it. Without the further parts yet to be described below, it would be possible to travel over the driving surface in the indicated preferred direction 15 of the truck.

The two recesses 21 and 22 in the quiver apparatus 20 are not covered by the quiver cover 23. Instead, a bollard barrier 30 is provided here. The bollard barrier part 30 consists of a plurality of parallel panels 31, 32, 33, 34. Illustrated in FIG. 1 are four parallel identical panels 31, 32, 33, 34. However, a different number of panels is also possible and they need not necessarily all be identical.

However, it is relevant that these panels are each constructed to be flat, with the planes of the faces lying essentially in the same plane as the presumed direction of travel of a truck or other vehicle approaching the path and road barrier. If such a vehicle were to come barreling towards the path and road barrier in the impact direction 15 and, from the ground surface, reach the top side 11 of the foundation 10, the vehicle, which is not depicted, would impact at the left impact face 35 of the bollard barrier part 30 in FIG. 1.

As can be seen, this impact face 35 is spanned by the narrow sides of the adjacently lying panels 31, 32, 33, 34 of the bollard barrier part 30.

The preferred embodiment of FIG. 1 already shows in the schematic view that the impact face 35 is curved, whereby, directed upwards, this curvature is oriented towards the approaching vehicle, that is, opposite to the impact direction 15.

The advantage of this concept lies in the fact that the vehicle is forced downwards when it impacts against the impact face 35 of the bollard barrier part 30 of the path and road barrier. This additionally prevents the vehicle from surmounting the obstacle formed by the path and road barrier.

The panel-shaped construction of the bollard barrier part 30 additionally stabilizes this bollard barrier part 30. The arrangement of a plurality of panels 31, 32, 33, 34 adjacent to one another in relation to the direction of impact results in the impacting vehicle losing additional kinetic energy when the panels rub against one another during impact or are bent against one another in the case of greater energy input and are thereby also possibly destroyed.

This effect of an energy absorption due to plastic deformation of the structure and a crushing together of the panels or layers is capable of stopping the approaching vehicle in an effective manner and also causes damage to the axles and other components of the vehicle.

In various embodiments, the panels can also be joined to one another by bolting or by adhesive bonding. It is also possible to arrange them at an even spacing or else at irregular spacings parallel with respect to one another.

In the case of a concept involving a plurality of bollard barrier parts of this kind or a plurality of path and road barriers of this kind for blocking off a broader region, it is also possible to join the panels of various bollard barrier parts 30 to one another by means of rigid pipes or solid rods of diverse cross section or else to choose flexible connectors in the form of chains or cords. In this way, it is possible to provide additional holding force or resistance energy against approaching vehicles.

However, the greatest advantage of the construction with the parallel panels lies in the fact that a very economical prefabrication of the parts of path and road barriers of this kind is possible. Namely, depending on need and location, it is essentially possible to decide spontaneously whether a bollard barrier part 30 is built out of four or five or seven or even ten panels of the same kind. The prerequisite is solely that the recesses 21 and 22 in the associated quiver apparatus 20 are large enough.

The structure consisting of a plurality of panels also makes it possible to construct the bollard barrier part 30 by manual manipulation, because it is possible for each individual panel to have a weight of less than 55 kilograms. It can therefore be handled by one person or by a few persons in order to insert successively a plurality of panels of the bollard barrier part 30 into the quiver apparatus 20 or into the recesses 21 and 22.

Besides the modular expandability of the bollard barrier parts 30 for higher so-called impact classes, a structure that is optimized in terms of topology can be provided.

Not illustrated are further possibilities, such as, for example, additional fastening elements for blocking pedestrian traffic or bicycle traffic from passing between two bollard barrier parts.

It can also be seen that the bollard barrier part 30, consisting of adjacently arranged panels 31, 32, 33, 34, has a structure that resembles an "A." For stiffening of the bollard barrier part 30, it is preferred to insert stiffening struts 38 between the impact face 35, which faces towards the approaching vehicle, and the back face 37, which faces away from the approaching vehicle, as a result of which the appearance of an "A" is created.

What is thus created overall is a panel 31, 32, 33, 34 having an edge that faces the vehicle and becomes a part of the impact face 35 of the entire bollard barrier part 30 and a back face 37 that faces away from the vehicle. The impact face 35 and the back face 37 are joined to one another through one stiffening strut or a plurality of stiffening struts 38. In this way, material recesses in the panel 31, 32, 33, 34 are formed between the edges and the stiffening struts 38.

The number of panels employed in a bollard barrier part 30 also depends on the impact loads that the path and road barrier will have to absorb. For the personnel engaged in creating the path and road barrier to be able to handle the panels manually, the panels cannot exceed a certain weight. In itself, this poses no problem, because it is possible by way of a larger number of panels to absorb any impact load.

The two outer panels 31 and 34 in the illustrated embodiment have side faces 36. These side faces can be utilized for attaching posters, advertising displays, company logos, emblems, or laser engravings or for other purposes of use. If, for example, such a blocking is employed near to a soccer stadium, the emblems of the sport club can be utilized here.

The individual panels 31, 32, 33, 34 of the bollard barrier part 30 can, for example, be constructed of crane structural steel, bainitic steel, martensite phase steel, or other high-strength steels. Also coming into consideration are fiber composite materials. In combination with the high-strength steel, panels composed of resilient elements can also be employed.

In the case of a material mix of the individual panels, a hybrid concept is created, which likewise has advantages for certain cases of application.

Besides the already described curvature in the impact direction or negative curvature, which leads to the application of a force against the vehicle, it is also possible to provide a height gradation of the panels. In this way, it is possible to choose the modular stiffness of the bearing structure and it is possible to target the destruction or capture of various structural components of the impacting vehicle. It is thereby possible to take into consideration any assumptions regarding the structure of the impacting vehicle.

The elements of the quiver apparatus 20 can also make use of crane structural steel, bainitic steel, martensite phase steel, fiber composite materials, and other materials.

It is also possible to provide the recesses 21 and 22 of the quiver apparatus 20 with a stronger horizontal component in order to work together with differently formed panel-like bollard barrier parts.

In further embodiments, which are not illustrated, it is also possible for the quiver apparatus 20 to be furnished with additional molded elements, which act to prevent the panels 31, 32, 33, 34 of the bollard barrier part 30 from being pulled out, namely, during both an impact of a vehicle and in the case of vandalism.

Also not depicted is the provision of a covered cable feedthrough in the foundation 10 in the recesses 21 and 22 of the quiver apparatus 20 and, from there, into the bollard barrier part 30 in order to provide an illumination. This illumination can occur for purposes of design, but also in order to prevent a vehicle from inadvertently driving against the path and road barrier at night.

The concept of the construction from a plurality of panels can be utilized, in addition, to provide shapes in the region of the bollard barrier part 30 that are not relevant in functional terms. Examples include images of palms or stars.

Smaller spikes can also be provided on the impact face 35 of the bollard barrier part 30 and, during an impact of the vehicle against the path and road barrier, can lead to additional damage to the vehicle.

The layered construction consisting of a plurality of panels has still a further advantage. A strong impact of a vehicle can create damage, such as, for example, cracks, in regions of a bollard barrier part 30. However, a crack in one of the panels 31, 32, 33, 34 does not lead to propagation of this crack into adjacent panels. Only one of the panels is therefore damaged, whereas the other panels are not affected. This increases the durability of the entire path and road barrier in the case, for example, of a massive impact involving a number of vehicles in succession.

Inside of the recesses 21 and 22 of the quiver apparatus 20, the panels 31, 32, 33, 34 of the bollard barrier part 30 can also be arranged in a tailored manner with respect to one another in accordance with the wedge principle, that is, for example, at angles of 15° with respect to one another. This results in a self-locking and a frictionally fitted bracing against being pulled out.

LIST OF REFERENCE NUMBERS

10 foundation
11 top side of the foundation 10, flush with the ground surface and the driving surface
12 lateral surface of the foundation 10
15 impact direction
20 quiver apparatus
21 recess
22 recess
23 quiver cover, flush with the top side of the foundation
24 reinforcing element of the quiver apparatus, here a rail
25 reinforcing element of the quiver apparatus, here a rail
30 bollard barrier part
31 panel
32 panel
33 panel
34 panel
35 impact face of the bollard barrier part 30
36 side face of the bollard barrier part 30
37 back face of the bollard barrier part 30
38 stiffening struts

What is claimed is:

1. A path or road barrier for vehicles, comprising:
a foundation, which can be inserted into a depression of the driving surface,
in which foundation a recess is located,
a bollard barrier part that is arranged in the recess of the foundation,
for vehicles with a preferred travel direction, which is oriented as the impact direction against the bollard barrier part,
wherein the bollard barrier part is built of two or more panels, which can be handled separately from one another,
wherein the panels are arranged parallel to one another and wherein the impact direction is oriented against an impact face of the bollard barrier part, said impact face being arranged perpendicularly to the panels,
a quiver apparatus which is arranged in the recess in the foundation and into which is inserted the bollard barrier part with its panels,
and wherein the quiver apparatus has at least two recesses, which are arranged in the impact direction one behind the other.

2. The path or road barrier for vehicles according to claim 1,
further characterized
in that the impact face of the bollard barrier part is formed by narrow sides of the panels of the bollard barrier part that are arranged adjacent to one another and parallel with respect to one another.

3. The path or road barrier for vehicles according to claim 1,
further characterized
in that the impact face of the bollard barrier part projects from the foundation perpendicularly upwards and is oriented upwards increasingly in the impact direction.

4. The path or road barrier for vehicles according to claim 1,
further characterized
in that each panel of the bollard barrier part has material recesses in its face, preferably bored holes or other shapes,
in that the impact face of the bollard barrier part forms, at the same time, the edges of the panels that face towards the vehicle,
in that the back face of the bollard barrier part forms the edges of the panels facing away from the vehicle, and
in that the impact face and the back face are joined to one another through at least one stiffening strut.

5. The path or road barrier for vehicles according to claim 1,
further characterized
in that one reinforcing element or a plurality of reinforcing elements of the quiver apparatus is or are inserted into the foundation adjacent to the quiver apparatus, as rails.

6. The path or road barrier for vehicles according to claim 1
further characterized
in that, as material for the bollard barrier part and/or the quiver apparatus, a steel, in particular a high-strength steel, preferably a crane structural steel, a bainitic steel, or a martensite phase steel, or, alternatively, a composition with fiber composite materials is used.

7. The path or road barrier for vehicles according to claim 1, further characterized in that, for resiliency or shock-absorption of the panels, resilient and/or shock-absorbing elements are arranged inside of the quiver apparatus.

8. A path or road barrier for vehicles having a foundation, which can be inserted into a depression of a driving surface, and in which the foundation has a recess;

a bollard barrier part that is arranged in the recess of the foundation;

wherein for vehicles with a predetermined travel direction, the vehicle is oriented in an impact direction against the bollard barrier part;

wherein the bollard barrier part is built of two or more panels;

wherein each bollard barrier part has an impact side that is narrower in width than a joined side thereof;

wherein the panels are arranged parallel to one another; and wherein the impact direction is oriented against an impact face that is formed by the impact side of the bollard barrier part, and said impact face being arranged perpendicularly to the joined sides of the panels.

9. The path or road barrier for vehicles according to claim 8, further characterized in that a quiver apparatus is provided, which is arranged in the recess in the foundation and into which is inserted the bollard barrier part with its panels.

10. The path or road barrier for vehicles according to claim 9, further characterized in that the quiver apparatus has at least two recesses, which are arranged in the impact direction, one behind the other, and wherein each panel includes separate panel legs accommodated in respective at least two recesses.

11. The path or road barrier for vehicles according to claim 10, further characterized in that the impact face of the bollard barrier part is formed by the panels of the bollard barrier part that are arranged adjacent to one another and parallel with respect to one another.

12. The path or road barrier for vehicles according to claim 8, further characterized in that the narrow sides of the panels of the bollard barrier part that are arranged adjacent to one another and parallel with respect to one another.

13. The path or road barrier for vehicles according to claim 8, in that the narrow side of each panel forms an arcuate impact face.

14. The path or road barrier for vehicles according to claim 8, further characterized in that the impact face of the bollard barrier part projects from the foundation perpendicularly upwards and is oriented upwards increasingly in the impact direction.

15. The path or road barrier for vehicles according to claim 8, further characterized in combination with a vehicle that is oriented in the impact direction against the bollard barrier part.

16. The path or road barrier for vehicles according to claim 8 further characterized wherein each of the two or more panels are of the same size and shape.

17. The path or road barrier for vehicles according to claim 8, further characterized wherein the impact face is formed by the narrow impact sides of the respective panels.

18. The path or road barrier for vehicles according to claim 17, further characterized wherein the entire impact face is formed by only the narrow impact sides of the respective panels.

19. The path or road barrier for vehicles according to claim 8, further characterized wherein each panel has separate panel legs connected by a stiffening strut.

20. A path or road barrier for vehicles having a foundation, which can be inserted into a depression of a driving surface, and in which the foundation has a recess;

a bollard barrier part that is arranged in the recess of the foundation;

wherein for vehicles with a predetermined travel direction, the vehicle is oriented in an impact direction against the bollard barrier part;

wherein the bollard barrier part is built of two or more panels;

wherein the panels are arranged parallel to one another;

wherein the impact direction is oriented against an impact face of the bollard barrier part, and said impact face being arranged perpendicularly to the panels;

wherein the impact face of the bollard barrier part forms, at the same time, the edges of the panels that face towards the vehicle, wherein a back face of the bollard barrier part forms the edges of the panels facing away from the vehicle, and and wherein the impact face and the back face are joined to one another through at least one stiffening strut.

* * * * *